US008167406B2

(12) United States Patent
Panchawagh et al.

(10) Patent No.: US 8,167,406 B2
(45) Date of Patent: May 1, 2012

(54) PRINTHEAD HAVING REINFORCED NOZZLE MEMBRANE STRUCTURE

(75) Inventors: Hrishikesh V. Panchawagh, Rochester, NY (US); John A. Lebens, Rush, NY (US)

(73) Assignee: Eastman Kodak Company, Rochester, NY (US)

( * ) Notice: Subject to any disclaimer, the term of this patent is extended or adjusted under 35 U.S.C. 154(b) by 365 days.

(21) Appl. No.: 12/511,147

(22) Filed: Jul. 29, 2009

(65) Prior Publication Data

US 2011/0025780 A1 Feb. 3, 2011

(51) Int. Cl.
*B41J 2/14* (2006.01)
*B41J 2/16* (2006.01)

(52) U.S. Cl. ..... 347/47; 347/65

(58) Field of Classification Search ..... 347/15, 347/40, 41, 43, 44–47, 64–65, 73–77, 82
See application file for complete search history.

(56) References Cited

U.S. PATENT DOCUMENTS 5,595,785 A * 1/1997 Hindagolla et al. ..... 430/320
6,079,821 A 6/2000 Chwalek et al.
6,439,703 B1 8/2002 Anagnostopoulos et al.
6,450,619 B1 9/2002 Anagnostopoulos et al.
6,457,807 B1 10/2002 Hawkins et al.
6,491,362 B1 12/2002 Jeanmaire
6,505,921 B2 1/2003 Chwalek et al.
6,554,410 B2 4/2003 Jeanmaire et al.
6,575,566 B1 6/2003 Jeanmaire et al.
6,588,888 B2 7/2003 Jeanmaire et al.
6,663,221 B2 12/2003 Anagnostopoulos et al.
6,793,328 B2 9/2004 Jeanmaire
6,827,429 B2 12/2004 Jeanmaire et al.
6,851,796 B2 2/2005 Jeanmaire et al.
6,926,389 B2 * 8/2005 Lee et al. ..... 347/56

* cited by examiner

*Primary Examiner* — Thinh Nguyen
(74) *Attorney, Agent, or Firm* — William R. Zimmerli

(57) ABSTRACT

A printhead includes a nozzle membrane, a substrate, and a support structure. The nozzle membrane includes an external surface, a length, and a plurality of nozzles located along the length of the nozzle membrane. The nozzle membrane is affixed to the substrate. The substrate includes a liquid feed channel that provides liquid to the plurality of nozzles of the nozzle membrane. The liquid feed channel extends along the length of the nozzle membrane such that the liquid feed channel is common to each nozzle of the plurality of nozzles of the nozzle membrane. The support structure is affixed to the external surface of the nozzle membrane to provide structural support to the nozzle membrane.

20 Claims, 12 Drawing Sheets

1. CMOS WAFER WITH NOZZLE BORES ETCHED IN DIELECTRIC MEMBRANE

2. DEPOSIT/LAMINATE FRONTSIDE SUPPORT LAYER

3. USE PHOTOLITHOGRAPHY TO PATTERN THE SUPPORT LAYER WITH OR WITHOUT A HARD MASK

4. ETCH BACKSIDE INK FEED CHANNEL IN SILICON

4. DEPOSIT A PASSIVATION LAYER ON FRONTSIDE AND PATTERN IT TO OPEN BOND-PADS (NOT SHOWN)

5. OPTIONAL PASSIVATION ON THE BACKSIDE

PRINTHEAD HAVING REINFORCED NOZZLE MEMBRANE STRUCTURE

CROSS REFERENCE TO RELATED APPLICATIONS

Reference is made to commonly-assigned, U.S. patent application Ser. No. 12/511,138, entitled "PRINTHEAD INCLUDING DUAL NOZZLE STRUCTURE" filed concurrently herewith.

FIELD OF THE INVENTION

This invention relates generally to the field of digitally controlled printing systems, and in particular to the printheads of these types of printing systems.

BACKGROUND OF THE INVENTION

Traditionally, inkjet printing is accomplished by one of two technologies referred to as "drop-on-demand" and "continuous" inkjet printing. In both, liquid, such as ink, is fed through channels formed in a print head. Each channel includes a nozzle from which droplets are selectively extruded and deposited upon a recording surface.

Drop on demand printing only provides drops (often referred to a "print drops") for impact upon a print media. Selective activation of an actuator causes the formation and ejection of a drop from a printhead that strikes the print media. The formation of printed images is achieved by controlling the individual formation of drops. Typically, one of two types of actuators is used in drop on demand printing—heat actuators and piezoelectric actuators. With heat actuators, a heater, placed at a convenient location adjacent to the nozzle, heats the ink. This causes a quantity of ink to phase change into a gaseous steam bubble that raises the internal ink pressure sufficiently for an ink droplet to be expelled. With piezoelectric actuators, an electric field is applied to a piezoelectric material possessing properties causing a wall of a liquid chamber adjacent to a nozzle to be displaced, thereby producing a pumping action that causes an ink droplet to be expelled.

Continuous inkjet printing uses a pressurized liquid source connected in fluid communication to a printhead to eject liquid jets from the printhead. Streams of drops are formed from the liquid jets. Some of these drops are selected to contact a print media (often referred to a "print drops") while others are selected to be collected and either recycled or discarded (often referred to as "non-print drops"). For example, when no print is desired, the drops are deflected into a capturing mechanism (commonly referred to as a catcher, interceptor, or gutter) and either recycled or discarded. When printing is desired, the drops are not deflected and allowed to strike a print media. Alternatively, deflected drops can be allowed to strike the print media, while non-deflected drops are collected in the capturing mechanism.

As the printing industry continues to develop these types of printing systems, aspects of these printing systems are refined in order to maintain various characteristics. For example, as longer printheads (often referred to as pagewide printheads) are developed, printhead components can be refined in order to maintain manufacturing costs at reasonable levels. Nozzle plates, for example, can be thinned or otherwise reduced in thickness while the channels, for example, that supply liquid to the nozzles are lengthened or otherwise increased in size. As a result, these printheads tend to be structurally weak so that if the printhead is subjected to mechanical stresses, for example, during packaging or operation, the printhead might sufficiently fatigue and prematurely fail.

As such, there is an ongoing effort to improve the structural integrity of printheads.

SUMMARY OF THE INVENTION

According to one feature of the present invention, a printhead includes a nozzle membrane, a substrate, and a support structure. The nozzle membrane includes an external surface, a length, and a plurality of nozzles located along the length of the nozzle membrane. The nozzle membrane is affixed to the substrate. The substrate includes a liquid feed channel that provides liquid to the plurality of nozzles of the nozzle membrane. The liquid feed channel extends along the length of the nozzle membrane such that the liquid feed channel is common to each nozzle of the plurality of nozzles of the nozzle membrane. The support structure is affixed to the external surface of the nozzle membrane to provide structural support to the nozzle membrane.

According to another feature of the present invention, a method of printing includes providing a printhead including: a nozzle membrane including an external surface, a length, and a plurality of nozzles located along the length of the nozzle membrane; a substrate to which the nozzle membrane is affixed, the substrate including a liquid feed channel that provides liquid to the plurality of nozzles of the nozzle membrane, the liquid feed channel extending along the length of the nozzle membrane such that the liquid feed channel is common to each nozzle of the plurality of nozzles of the nozzle membrane; a support structure affixed to the external surface of the nozzle membrane to provide structural support to the nozzle membrane; and a drop stimulation device; providing a liquid under pressure sufficient to eject jets of the liquid through the plurality of nozzles; and actuating the drop stimulation device to form drops from the jets of liquid.

BRIEF DESCRIPTION OF THE DRAWINGS

In the detailed description of the example embodiments of the invention presented below, reference is made to the accompanying drawings, in which.

DETAILED DESCRIPTION OF THE INVENTION

Figure 1:
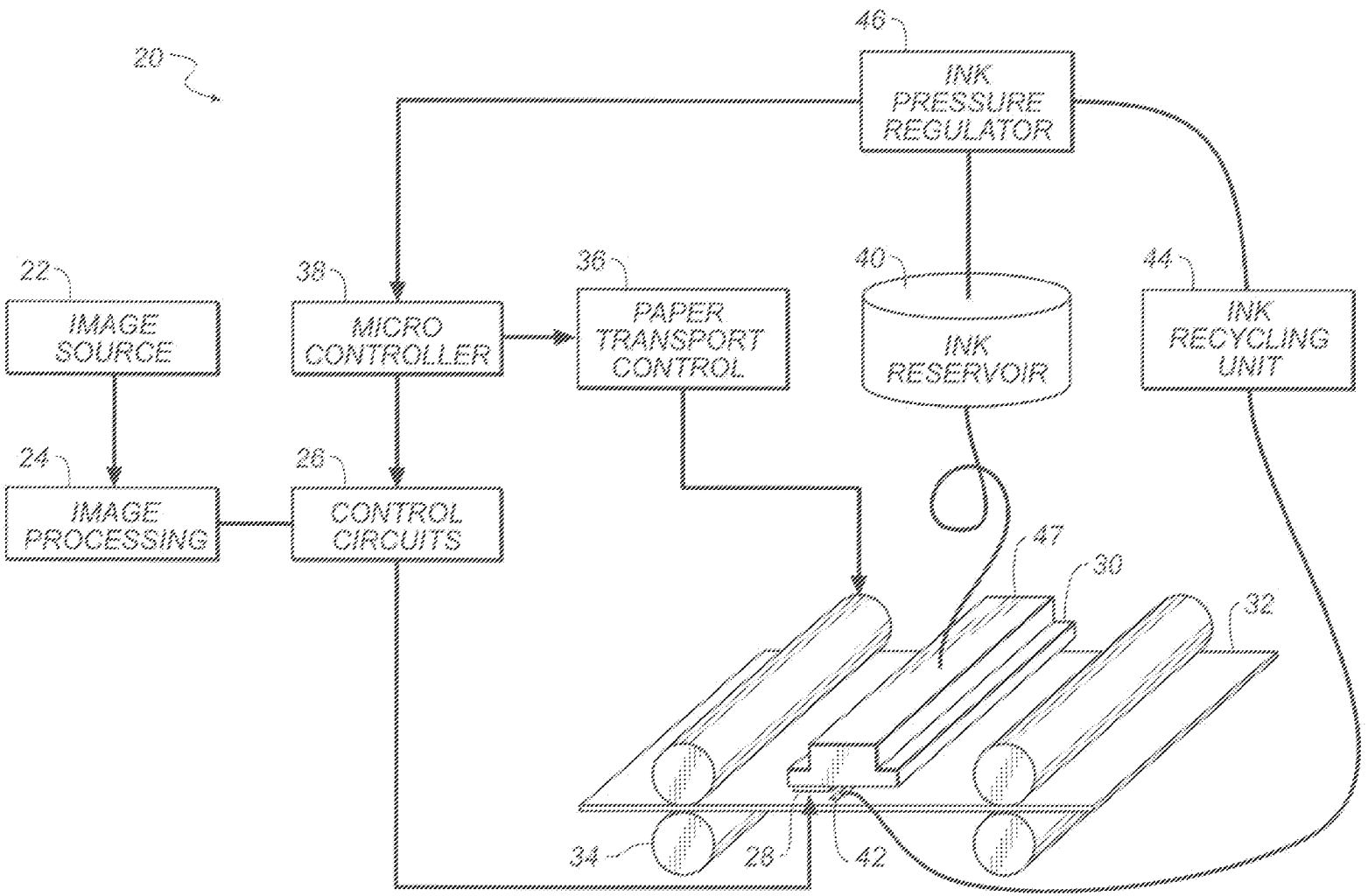
FIG. 1 is a simplified schematic block diagram of an example embodiment of a printing system made in accordance with the present invention.

The present description will be directed in particular to elements forming part of, or cooperating more directly with, apparatus in accordance with the present invention. It is to be understood that elements not specifically shown or described may take various forms well known to those skilled in the art. In the following description and drawings, identical reference numerals have been used, where possible, to designate identical elements.

The example embodiments of the present invention are illustrated schematically and not to scale for the sake of clarity. One of the ordinary skills in the art will be able to readily determine the specific size and interconnections of the elements of the example embodiments of the present invention.

As described herein, the example embodiments of the present invention provide a printhead or printhead components typically used in inkjet printing systems. However, many other applications are emerging which use inkjet printheads to emit liquids (other than inks) that need to be finely metered and deposited with high spatial precision. As such, as described herein, the terms "liquid" and "ink" refer to any material that can be ejected by the printhead or printhead components described below.

Referring to FIG. 1, a continuous printing system 20 includes an image source 22 such as a scanner or computer which provides raster image data, outline image data in the form of a page description language, or other forms of digital image data. This image data is converted to half-toned bitmap image data by an image processing unit 24 which also stores the image data in memory. A plurality of drop forming mechanism control circuits 26 read data from the image memory and apply time-varying electrical pulses to a drop forming mechanism(s) 28 that are associated with one or more nozzles of a printhead 30. These pulses are applied at an appropriate time, and to the appropriate nozzle, so that drops formed from a continuous ink jet stream will form spots on a recording medium 32 in the appropriate position designated by the data in the image memory.

Recording medium 32 is moved relative to printhead 30 by a recording medium transport system 34, which is electronically controlled by a recording medium transport control system 36, and which in turn is controlled by a micro-controller 38. The recording medium transport system shown in FIG. 1 is a schematic only, and many different mechanical configurations are possible. For example, a transfer roller could be used as recording medium transport system 34 to facilitate transfer of the ink drops to recording medium 32. Such transfer roller technology is well known in the art. In the case of page width printheads, it is most convenient to move recording medium 32 past a stationary printhead. However, in the case of scanning print systems, it is usually most convenient to move the printhead along one axis (the sub-scanning direction) and the recording medium along an orthogonal axis (the main scanning direction) in a relative raster motion.

Ink is contained in an ink reservoir 40 under pressure. In the non-printing state, continuous ink jet drop streams are unable to reach recording medium 32 due to an ink catcher 42 that blocks the stream and which may allow a portion of the ink to be recycled by an ink recycling unit 44. The ink recycling unit reconditions the ink and feeds it back to reservoir 40. Such ink recycling units are well known in the art. The ink pressure suitable for optimal operation will depend on a number of factors, including geometry and thermal properties of the nozzles and properties of the ink. A constant ink pressure can be achieved by applying pressure to ink reservoir 40 under the control of ink pressure regulator 46. Alternatively, the ink reservoir can be left unpressurized, or even under a reduced pressure (vacuum), and a pump is employed to deliver ink from the ink reservoir under pressure to the printhead 30. In such an embodiment, the ink pressure regulator 46 can comprise an ink pump control system. As shown in FIG. 1, catcher 42 is a type of catcher commonly referred to as a "knife edge" catcher.

The ink is distributed to printhead 30 through an ink channel 47. The ink preferably flows through slots or holes etched through a silicon substrate of printhead 30 to its front surface, where a plurality of nozzles and drop forming mechanisms, for example, heaters, are situated. When printhead 30 is fabricated from silicon, drop forming mechanism control circuits 26 can be integrated with the printhead. Printhead 30 also includes a deflection mechanism (not shown in FIG. 1) which is described in more detail below with reference to FIGS. 2 and 3.

Figure 2:
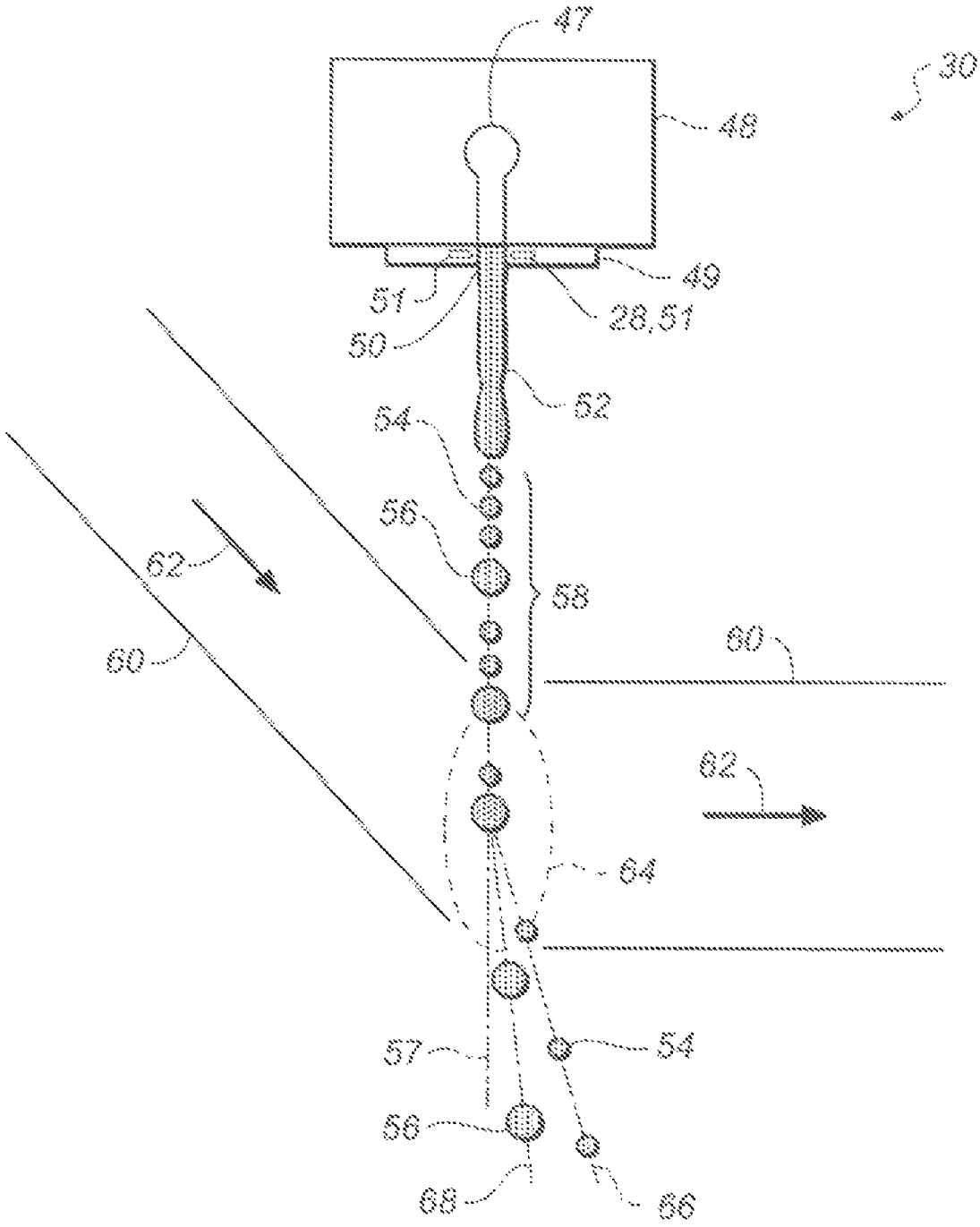
FIG. 2 is a schematic view of an example embodiment of a printhead made in accordance with the present invention.
Figure 3:
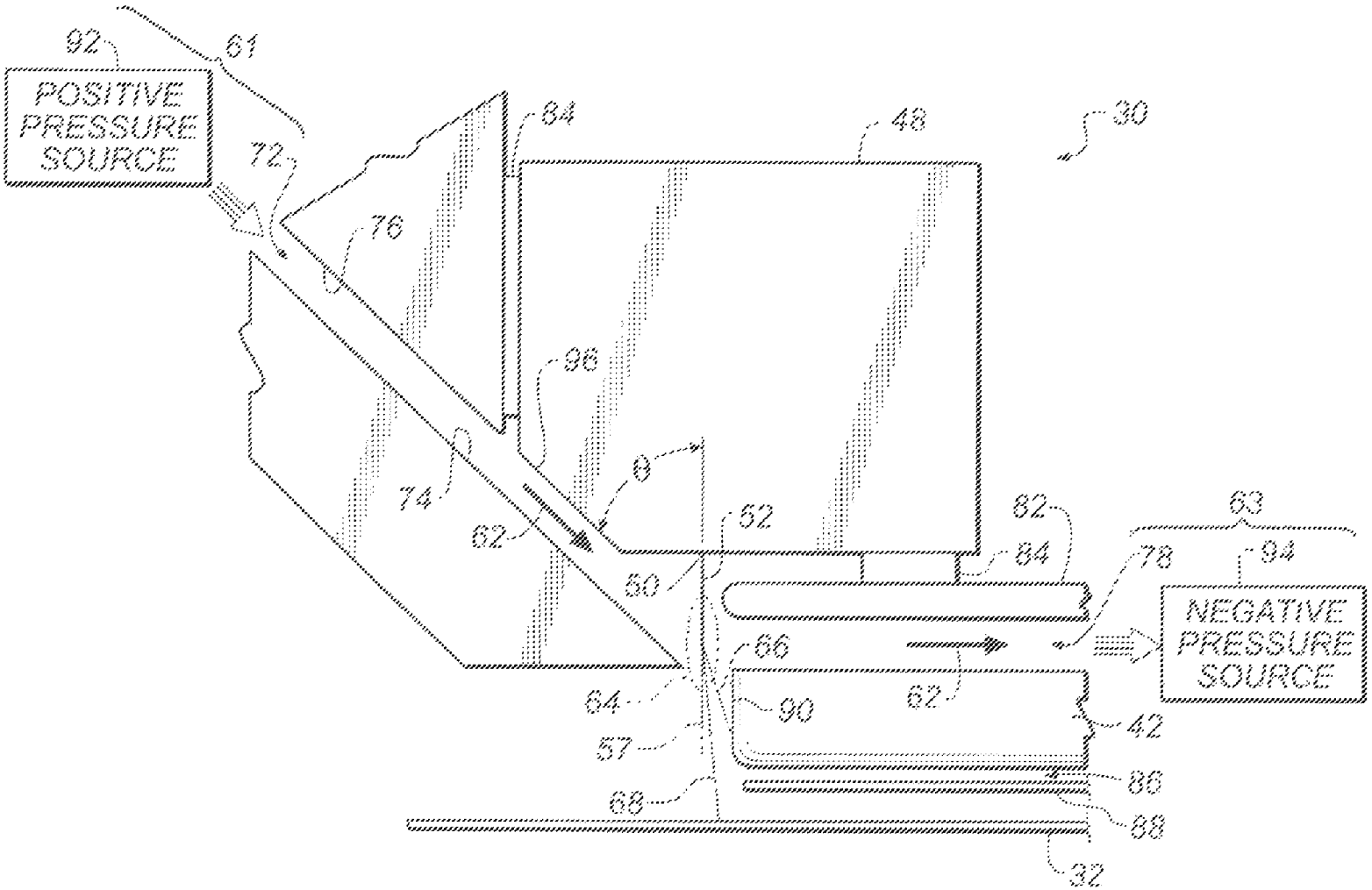
FIG. 3 is a schematic view of an example embodiment of a continuous printhead made in accordance with the present invention.

Referring to FIG. 2, a schematic view of continuous liquid printhead 30 is shown. A jetting module 48 of printhead 30 includes an array or a plurality of nozzles 50 formed in a nozzle plate 49. In FIG. 2, nozzle plate 49 is affixed to jetting module 48. However, as shown in FIG. 3, nozzle plate 49 can be integrally formed with jetting module 48.

Liquid, for example, ink, is emitted under pressure through each nozzle 50 of the array to form filaments of liquid 52. In FIG. 2, the array or plurality of nozzles extends into and out of the figure.

Jetting module 48 is operable to form liquid drops having a first size or volume and liquid drops having a second size or volume through each nozzle. To accomplish this, jetting module 48 includes a drop stimulation or drop forming device 28, for example, a heater or a piezoelectric actuator, that, when selectively activated, perturbs each filament of liquid 52, for example, ink, to induce portions of each filament to breakoff from the filament and coalesce to form drops 54, 56.

In FIG. 2, drop forming device 28 is a heater 51, for example, an asymmetric heater or a ring heater (either segmented or not segmented), located in a nozzle plate 49 on one or both sides of nozzle 50. This type of drop formation is known and has been described in one or more of the following: U.S. Pat. No. 6,457,807 B1, issued to Hawkins et al., on Oct. 1, 2002; U.S. Pat. No. 6,491,362 B1, issued to Jeanmaire, on Dec. 10, 2002; U.S. Pat. No. 6,505,921 B2, issued to Chwalek et al., on Jan. 14, 2003; U.S. Pat. No. 6,554,410 B2, issued to Jeanmaire et al., on Apr. 29, 2003; U.S. Pat. No. 6,575,566 B1, issued to Jeanmaire et al., on Jun. 10, 2003; U.S. Pat. No. 6,588,888 B2, issued to Jeanmaire et al., on Jul. 8, 2003; U.S. Pat. No. 6,793,328 B2, issued to Jeanmaire, on Sep. 21, 2004; U.S. Pat. No. 6,827,429 B2, issued to Jeanmaire et al., on Dec. 7, 2004; and U.S. Pat. No. 6,851,796 B2, issued to Jeanmaire et al., on Feb. 8, 2005.

Typically, one drop forming device 28 is associated with each nozzle 50 of the nozzle array. However, a drop forming device 28 can be associated with groups of nozzles 50 or all of nozzles 50 of the nozzle array.

When printhead 30 is in operation, drops 54, 56 are typically created in a plurality of sizes or volumes, for example, in the form of large drops 56, a first size or volume, and small drops 54, a second size or volume. The ratio of the mass of the large drops 56 to the mass of the small drops 54 is typically approximately an integer between 2 and 10. A drop stream 58 including drops 54, 56 follows a drop path or trajectory 57.

Printhead 30 also includes a gas flow deflection mechanism 60 that directs a flow of gas 62, for example, air, past a portion of the drop trajectory 57. This portion of the drop trajectory is called the deflection zone 64. As the flow of gas 62 interacts with drops 54, 56 in deflection zone 64 it alters the drop trajectories. As the drop trajectories pass out of the deflection zone 64 they are traveling at an angle, called a deflection angle, relative to the undeflected drop trajectory 57.

Small drops 54 are more affected by the flow of gas than are large drops 56 so that the small drop trajectory 66 diverges from the large drop trajectory 68. That is, the deflection angle for small drops 54 is larger than for large drops 56. The flow of gas 62 provides sufficient drop deflection and therefore sufficient divergence of the small and large drop trajectories so that catcher 42 (shown in FIGS. 1 and 3) can be positioned to intercept one of the small drop trajectory 66 and the large drop trajectory 68 so that drops following the trajectory are collected by catcher 42 while drops following the other trajectory bypass the catcher and impinge a recording medium 32 (shown in FIGS. 1 and 3).

When catcher 42 is positioned to intercept large drop trajectory 68, small drops 54 are deflected sufficiently to avoid contact with catcher 42 and strike the print media. As the small drops are printed, this is called small drop print mode. When catcher 42 is positioned to intercept small drop trajectory 66, large drops 56 are the drops that print. This is referred to as large drop print mode.

Referring to FIG. 3, jetting module 48 includes an array or a plurality of nozzles 50. Liquid, for example, ink, supplied through channel 47, is emitted under pressure through each nozzle 50 of the array to form filaments of liquid 52. In FIG. 3, the array or plurality of nozzles 50 extends into and out of the figure.

Drop stimulation or drop forming device 28 (shown in FIGS. 1 and 2) associated with jetting module 48 is selectively actuated to perturb the filament of liquid 52 to induce portions of the filament to break off from the filament to form drops. In this way, drops are selectively created in the form of large drops and small drops that travel toward a recording medium 32.

Positive pressure gas flow structure 61 of gas flow deflection mechanism 60 is located on a first side of drop trajectory 57. Positive pressure gas flow structure 61 includes first gas flow duct 72 that includes a lower wall 74 and an upper wall 76. Gas flow duct 72 directs gas flow 62 supplied from a positive pressure source 92 at downward angle θ of approximately a 45° relative to liquid filament 52 toward drop deflection zone 64 (also shown in FIG. 2). An optional seal(s) 84 provides an air seal between jetting module 48 and upper wall 76 of gas flow duct 72.

Upper wall 76 of gas flow duct 72 does not need to extend to drop deflection zone 64 (as shown in FIG. 2). In FIG. 3, upper wall 76 ends at a wall 96 of jetting module 48. Wall 96 of jetting module 48 serves as a portion of upper wall 76 ending at drop deflection zone 64.

Negative pressure gas flow structure 63 of gas flow deflection mechanism 60 is located on a second side of drop trajectory 57. Negative pressure gas flow structure includes a second gas flow duct 78 located between catcher 42 and an upper wall 82 that exhausts gas flow from deflection zone 64. Second duct 78 is connected to a negative pressure source 94 that is used to help remove gas flowing through second duct 78. An optional seal(s) 84 provides an air seal between jetting module 48 and upper wall 82.

As shown in FIG. 3, gas flow deflection mechanism 60 includes positive pressure source 92 and negative pressure source 94. However, depending on the specific application contemplated, gas flow deflection mechanism 60 can include only one of positive pressure source 92 and negative pressure source 94.

Gas supplied by first gas flow duct 72 is directed into the drop deflection zone 64, where it causes large drops 56 to follow large drop trajectory 68 and small drops 54 to follow small drop trajectory 66. As shown in FIG. 3, small drop trajectory 66 is intercepted by a front face 90 of catcher 42. Small drops 54 contact face 90 and flow down face 90 and into a liquid return duct 86 located or formed between catcher 42 and a plate 88. Collected liquid is either recycled and returned to ink reservoir 40 (shown in FIG. 1) for reuse or discarded. Large drops 56 bypass catcher 42 and travel on to recording medium 32. Alternatively, catcher 42 can be positioned to intercept large drop trajectory 68. Large drops 56 contact catcher 42 and flow into a liquid return duct located or formed in catcher 42. Collected liquid is either recycled for reuse or discarded. Small drops 54 bypass catcher 42 and travel on to recording medium 32.

Alternatively, deflection can be accomplished by applying heat asymmetrically to filament of liquid 52 using an asymmetric heater 51. When used in this capacity, asymmetric heater 51 typically operates as the drop forming mechanism in addition to the deflection mechanism. This type of drop formation and deflection is known having been described in, for example, U.S. Pat. No. 6,079,821, issued to Chwalek et al., on Jun. 27, 2000. Conventional electrostatic deflection can also be used to accomplish drop deflection.

As shown in FIG. 3, catcher 42 is a type of catcher commonly referred to as a "Coanda" catcher. However, the "knife edge" catcher shown in FIG. 1 and the "Coanda" catcher shown in FIG. 3 are interchangeable and work equally well. Alternatively, catcher 42 can be of any suitable design including, but not limited to, a porous face catcher, a delimited edge catcher, or combinations of any of those described above.

Referring to FIGS. 4-7 and 12, example embodiments of a printhead 30 made in accordance with the present invention are shown. A jetting module 48 of printhead 30 includes a nozzle membrane 100, a substrate 102, and a support structure 104. Nozzle membrane 100 includes an external surface 106 and a length dimension 108 and a width dimension 110. Printhead 30 also includes length dimension 108 and width dimension 110. A plurality of nozzles 50 is located along the length 108 of nozzle membrane 100 (and printhead 30). Substrate 102 and nozzle membrane 100 are affixed to each other. Substrate 102 and nozzle membrane 100 are often referred to as a CMOS-MEMS nozzle plate.

Substrate 102 includes a liquid feed channel 47 that provides liquid to the plurality of nozzles 50 located in nozzle membrane 100. Liquid feed channel 47 extends along the length 108 of nozzle membrane 100 such that liquid feed channel 47 is common to each nozzle 50 of the plurality of nozzles 50 of nozzle membrane 100. Including a liquid feed channel that is common to nozzles 50 helps to reduce the likelihood of drop misdirection caused by, for example, misdirected liquid jets. Portions 116 of substrate 102 form walls 118 that help to define the liquid feed channel 47. Support structure 104 is affixed to the external surface 106 of nozzle membrane 100 to provide structural support to nozzle membrane 100.

Figure 4:
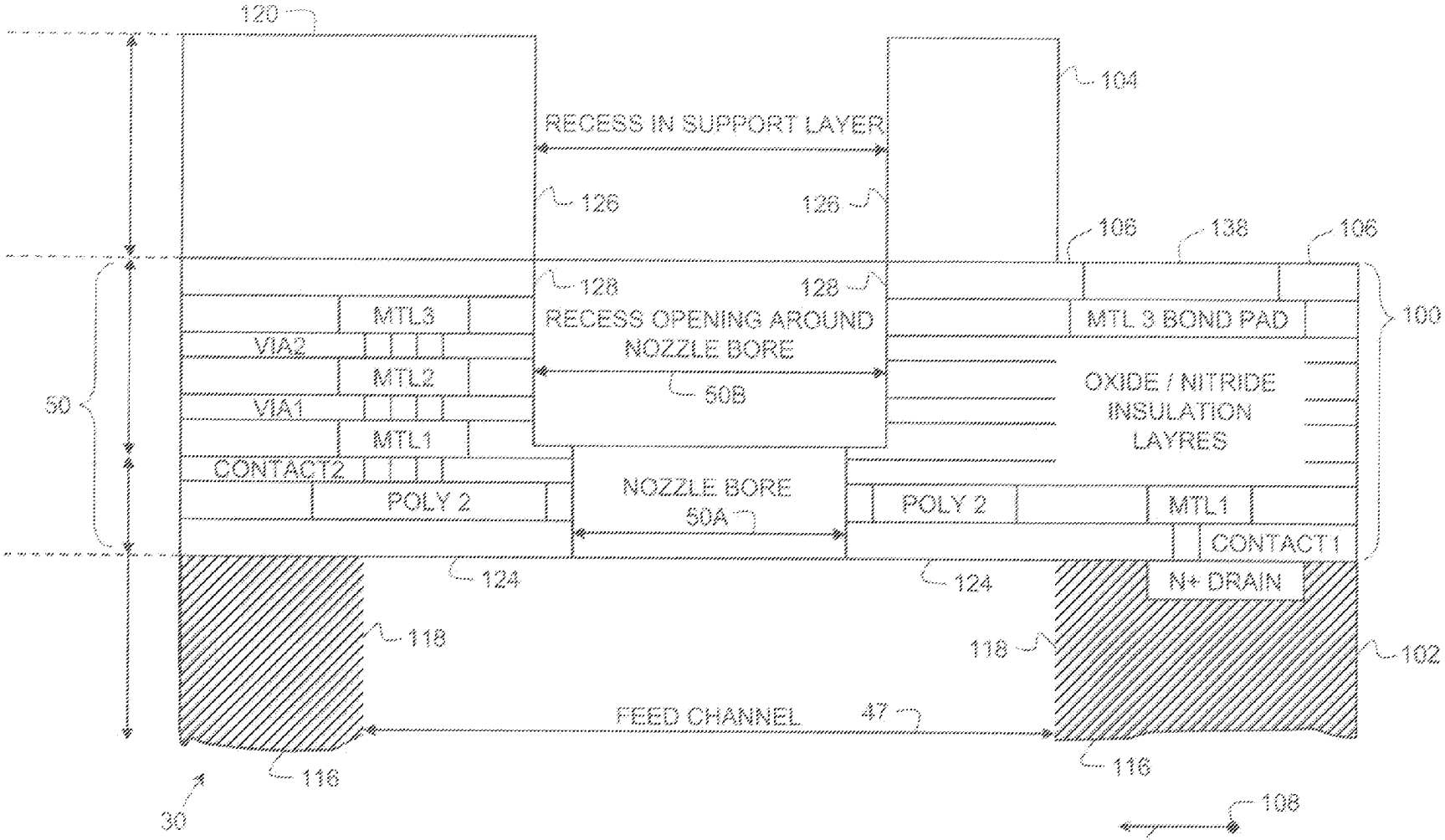
FIG. 4 shows a schematic cross sectional view of an example embodiment of a printhead made in accordance with the present invention.
Figure 6:
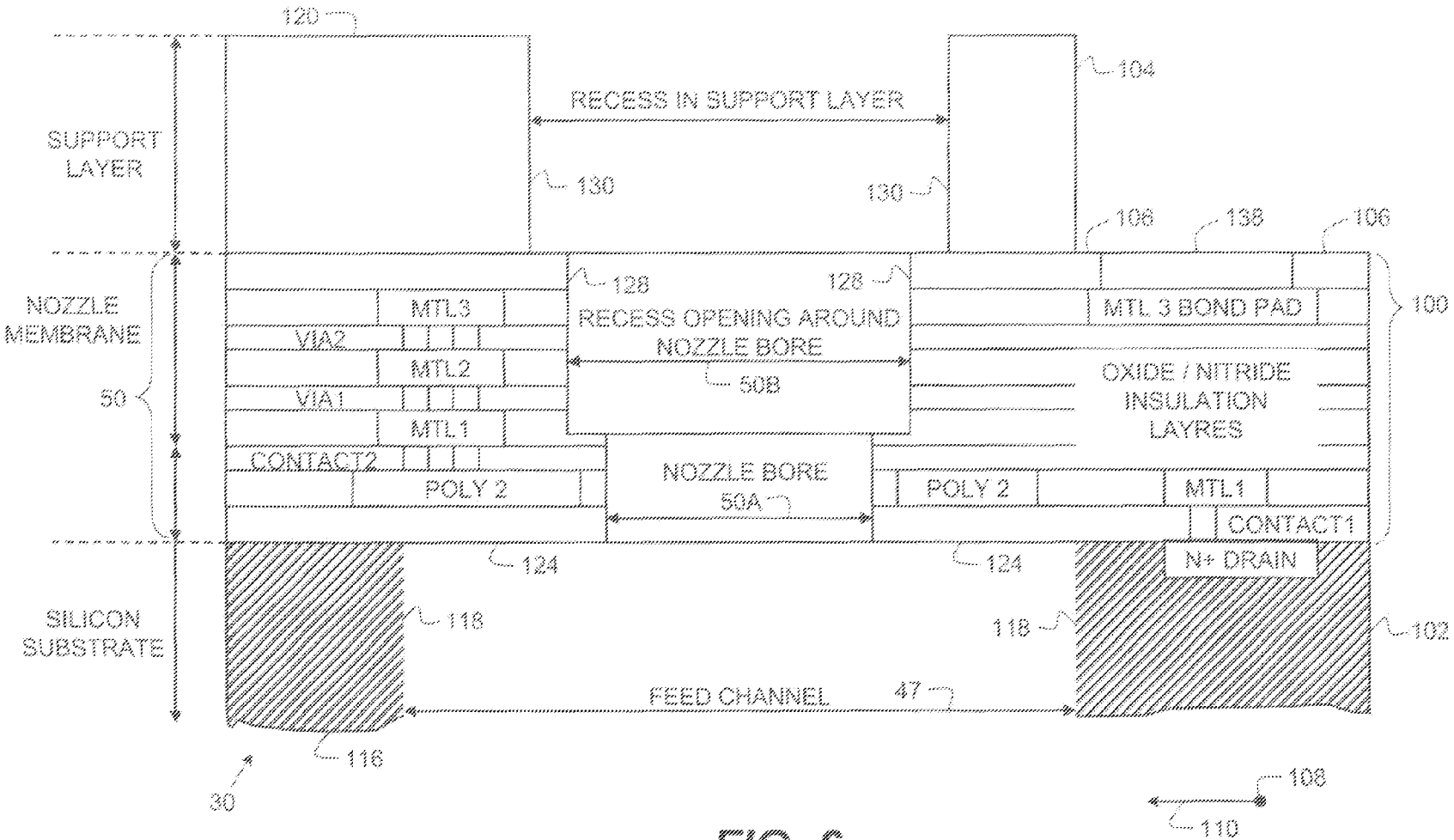
FIG. 6 is a schematic cross sectional view of another example embodiment of a printhead made in accordance with the present invention.

Substrate 102 is a silicon substrate. Nozzle membrane 100 includes integrated CMOS circuitry fabricated on substrate 102 using, for example, a CMOS process that includes a standard 0.5 micrometers mixed signal process incorporating two levels of polysilicon and three levels of metal. In FIGS. 4 and 6, this process is represented by the three layers of metal (MTL 1, MTL 2, and MTL 3) shown interconnected with vias (VIA 1 and VIA 2). Also, polysilicon level 2 and an N+ diffusion and contact to metal layer 1 are drawn to indicate active drive circuitry in the silicon substrate 102. Gate electrodes for the CMOS transistor devices are formed from one of the polysilicon layers (POLY 1, POLY 2). Because of the need to electrically insulate the metal layers, dielectric layers are deposited between them typically making the total thickness of the nozzle membrane 100 on silicon substrate 102 about 4.5 micrometers.

The CMOS process also provides a layer of polysilicon (POLY 1, POLY 2) as a stimulation device, for example, a heater element for heating liquid in each nozzle 50. During fabrication, a recess 50B over nozzle bore 50A of nozzle 50 can be etched at the same time as the oxide/nitride film over the bond pads are etched while the bores are photolithographically defined and etched subsequently, since such steps are compatible with VLSI CMOS processing.

As a result of the conventional CMOS fabrication steps a silicon substrate of approximately 675 micrometers in thickness and about 6 inches in diameter is provided. Larger or smaller diameter silicon wafers can be used equally as well. A plurality of transistors are formed in the silicon substrate through conventional steps of selectively depositing various materials to form these transistors as is well known in the industry. Supported on the silicon substrate are a series of layers eventually forming an oxide/nitride insulating layer that has one or more layers of polysilicon and metal layers formed therein in accordance with desired pattern. Vias are provided between various layers as needed and to the bond pads. The various bond pads are provided to make respective connections of data, latch clock, enable clocks, and power provided from a circuit board mounted adjacent the printhead or from a remote location. Although only one of the bond pads is shown it will be understood that multiple bond pads are formed in the nozzle array. The nozzle membrane structure shown in FIGS. 4 and 6 typically, provides the drive circuitry, for example, the interconnects, transistors and logic gates for controlling printhead operation as well as the nozzle structure above the silicon substrate 102. This drive circuitry is in electrical communication with the stimulation device.

The recessed opening above the bore may have a variety of sizes and shapes depending on the bore diameter and the amount of added resistance and energy dissipation that is tolerable. The added resistance is due to the length of polysilicon that is needed to extend from the metal and via contact area to the heater at the edge of the bore. One shape is a circularly cylindrical recessed opening, so the net effect is that the recessed opening may range in size from 10 micrometers larger in diameter than the bore to 100 micrometers larger in diameter than the bore. Of course, the recessed opening cannot be so large as to impinge upon a neighboring nozzle, nor compromise the integrity of the metal layers and vias. For the typical 8 to 15 micrometer diameter bore, the recessed opening is typically 12-32 micrometers in diameter.

The recessed opening does not have to be circular. For example, the recessed opening can be elliptical, and oriented in such away that a line drawn through the center of the ellipse along the longer symmetry direction of the ellipse (longest diameter) is approximately perpendicular to a line drawn through the row of nozzles. In the event of any fluid buildup inside this recessed opening, this elongation of the recessed opening allows more room or volume for such fluid, thus minimizing any impact of such fluid buildup on the performance of the nozzle, yet allows for a high nozzle density along the row of nozzles. Of course, elliptical is but one of a number of elongated, yet symmetrical, shapes for this recessed opening, and thus the specification of the ellipse is not meant as a limitation to the shape of the recessed opening.

Regardless of the shape of the recessed opening, the depth of the recessed opening is typically about 3.5 micrometers deep resulting in a bore membrane thickness that is typically 1.0 micrometers. This recessed bore opening may range from 1 micrometer deep to 3.5 micrometers deep leaving a bore membrane thickness that may range from 3.5 micrometers think to 1 micrometer thick, respectively. It will be understood of course that along the silicon array many nozzle bores are simultaneously etched. The embedded heater element effectively surrounds each nozzle bore and is proximate to the nozzle bore which reduces the temperature requirement of the heater for heating ink drops in the bore.

At this point, the silicon wafers are taken out of the CMOS facility. The support layer 104 is typically coated and patterned at this stage. Additionally, the silicon wafers are thinned from their initial thickness of 675 micrometers to about 300 micrometers. A mask to open ink channels is then applied to the backside of the wafers and the silicon is etched in an STS etcher, all the way to the front surface of the silicon. Alignment of the ink channel openings in the back of the wafer to the nozzle array in the front of the wafer may be provided with an aligner system such as the Karl Suss 1X aligner system.

Still referring to FIGS. 4-7 and 12, the liquid feed channel 47 formed in the silicon substrate is shown as being a rectangular cavity passing centrally beneath the nozzle 50 array. Traditionally, the combination of a long cavity liquid feed channel 47 in the center of the nozzle array and the thickness of the nozzle membrane 100 might structurally weaken the printhead 30 so that if the printhead 30 were subject to mechanical stresses, such as during packaging or operation, nozzle membrane 100 could crack. The presence of support structure 104, which is affixed to the external surface 106 of nozzle membrane 100, provides structural support to nozzle membrane 100 reducing the likelihood of nozzle membrane 100 failure. Inclusion of support structure 104 in printhead 30 also allows an internal surface 124 of nozzle membrane 100 that is adjacent to liquid feed channel 47 and also helps to define channel 47 to be substantially planner which helps to create a common liquid feed channel 47 relative to nozzles 50. Support structure 104 is void of the stimulation devices and drive circuitry described above. Additionally or alternatively, support structure 104 can be coated with a thin passivation layer in order to improve jet straightness and corrosion resistance.

Figure 5:
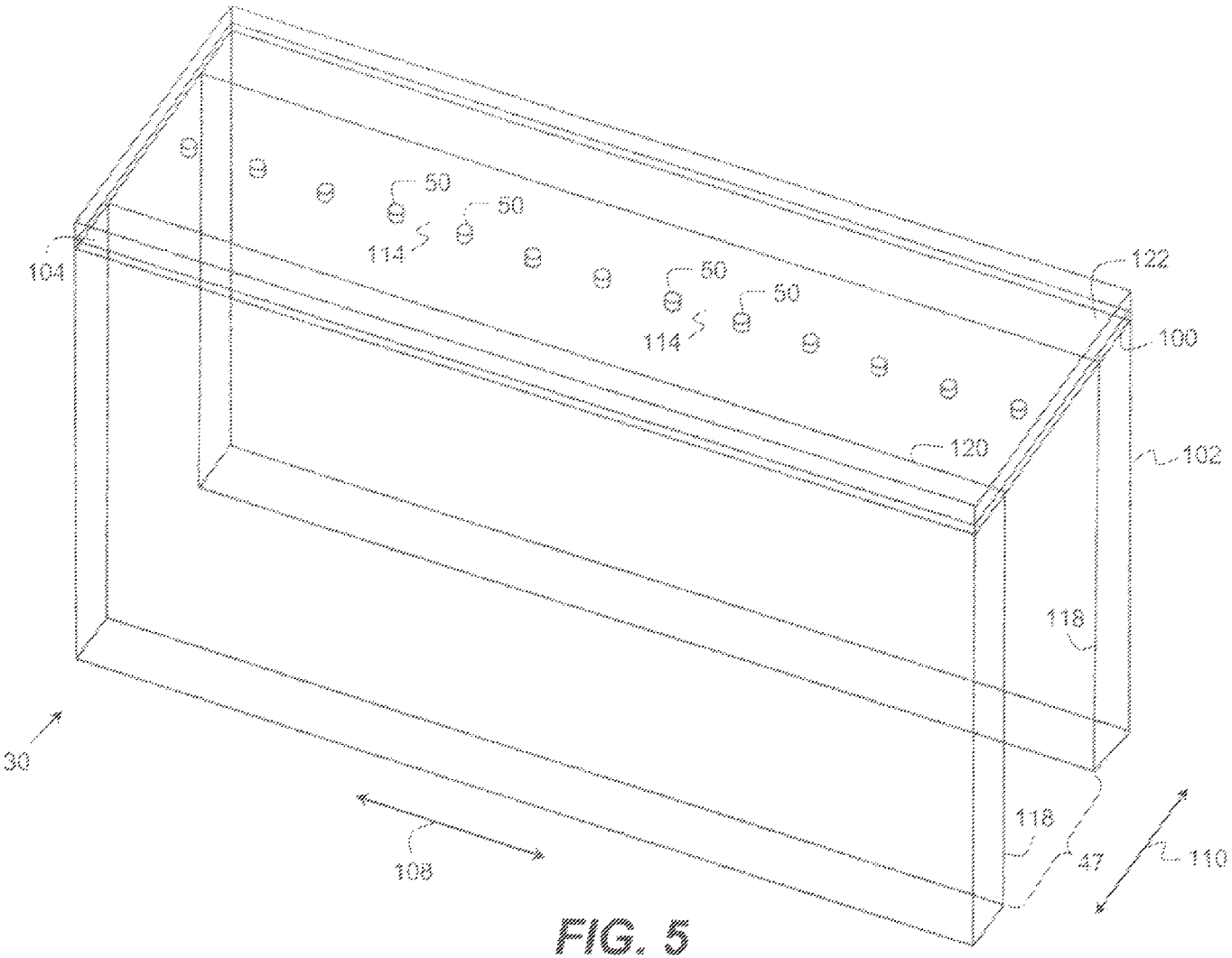
FIG. 5 is a schematic perspective view of the example embodiment of the printhead shown in FIG. 1.
Figure 7:
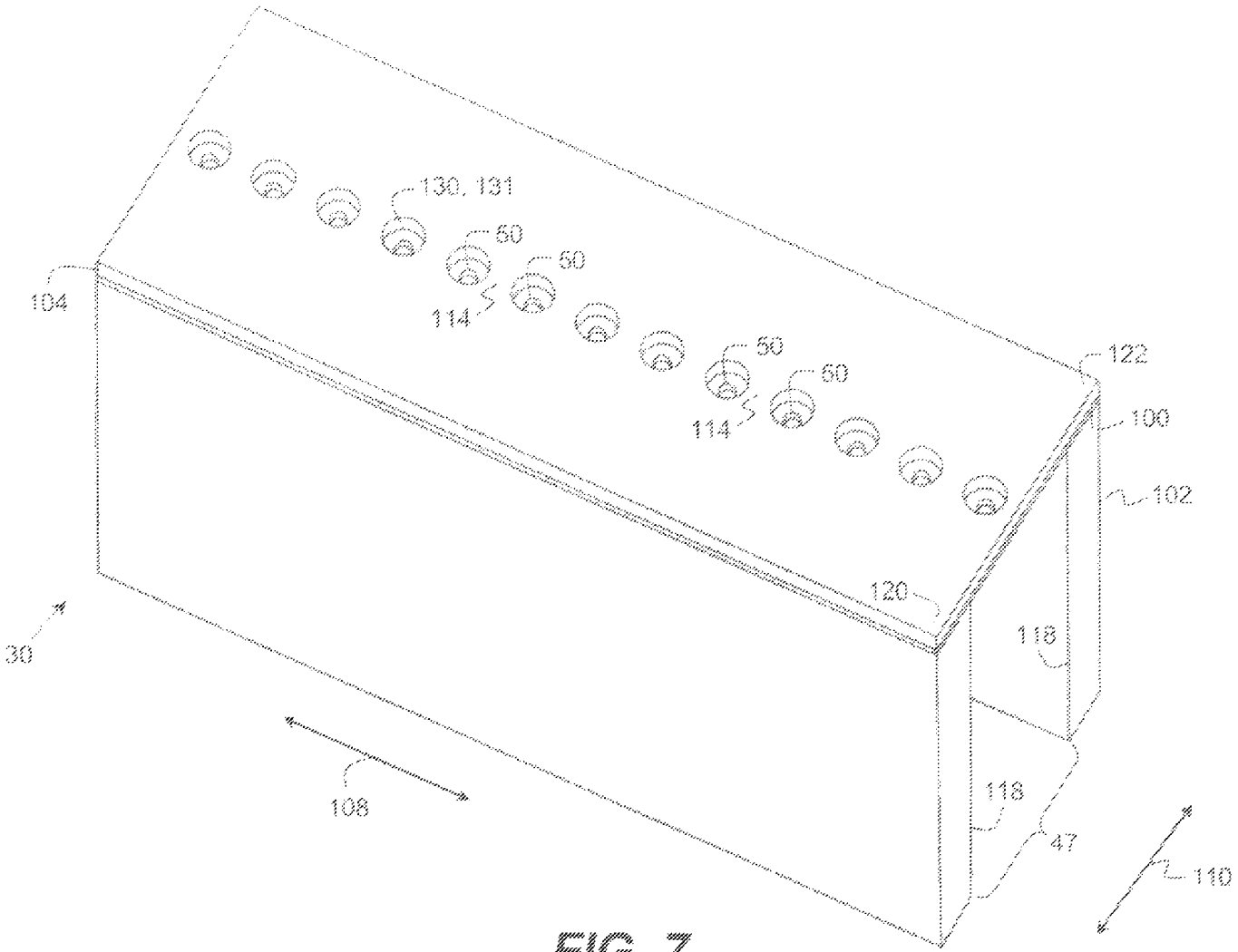
FIG. 7 is a schematic perspective view of another example embodiment of a printhead made in accordance with the present invention.
Figure 12:
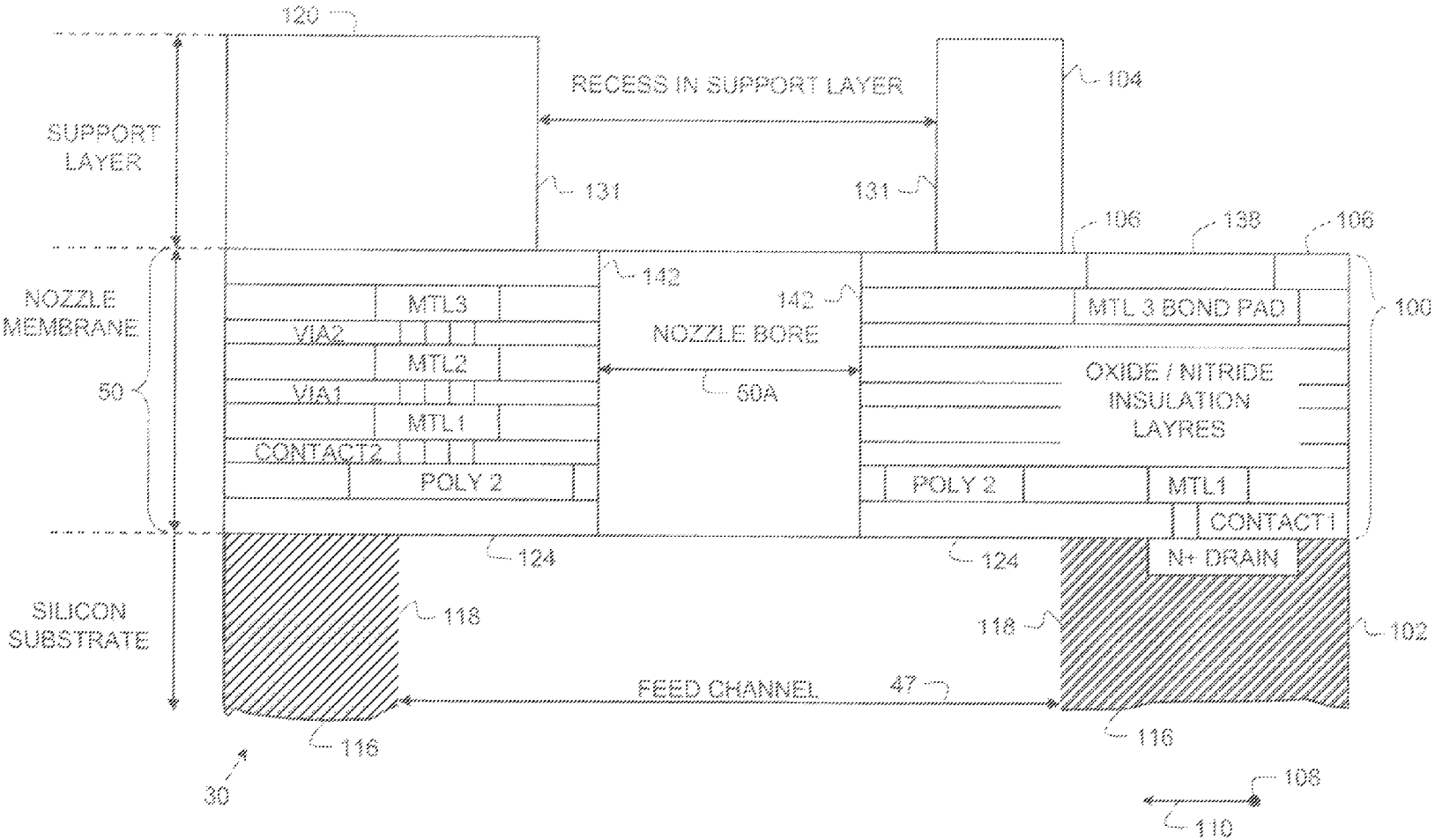
FIG. 12 shows a schematic cross sectional view of an example embodiment of a printhead made in accordance with the present invention.

As shown in FIGS. 4-6, nozzle 50 of nozzle membrane 100 includes a nozzle bore 50A and a recessed opening 50B. In FIGS. 4 and 5, portions 126 of support structure 104 are co-linear with the inner wall 128 of recessed opening 50B of nozzle 50. In FIG. 6, portions 130 of the support structure 104 are recessed relative to the inner wall 128 of recessed opening 50B of the nozzle 50 in order to help maintain jet straightness. As shown in FIGS. 7 and 12, nozzle 50 of nozzle membrane 100 includes only nozzle bore 50A. Portions 131 of the support structure 104 are recessed relative to the inner wall 142 of nozzle bore 50A of the nozzle 50 in order to help maintain jet straightness. Typically, the recessed portion 130, 131 is offset from the inner wall 128 of recessed opening 50B of the nozzle 50 or the inner wall 142 of nozzle bore 50A of the nozzle 50 by a range from 0 to 30 micrometers. The thickness of support structure 104 typically ranges from 3 to 30 micrometers. As shown in FIGS. 4, 6, and 12, openings 138 are also provided in support structure 104 to access bond pads on the nozzle plate so that external electrical contacts can be made.

Figure 8:
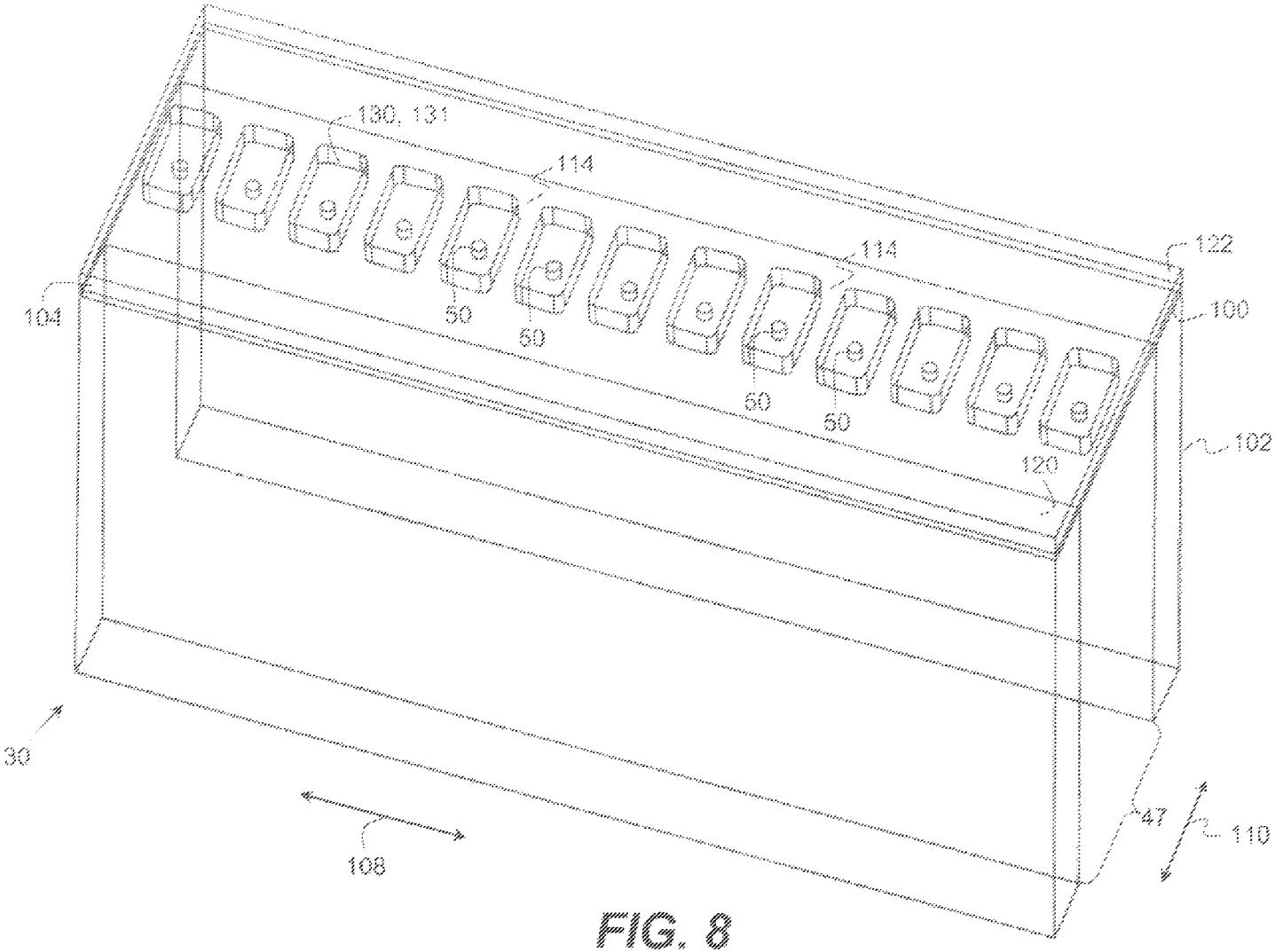
FIG. 8 is a schematic perspective view of another example embodiment of a printhead made in accordance with the present invention.
Figure 9:
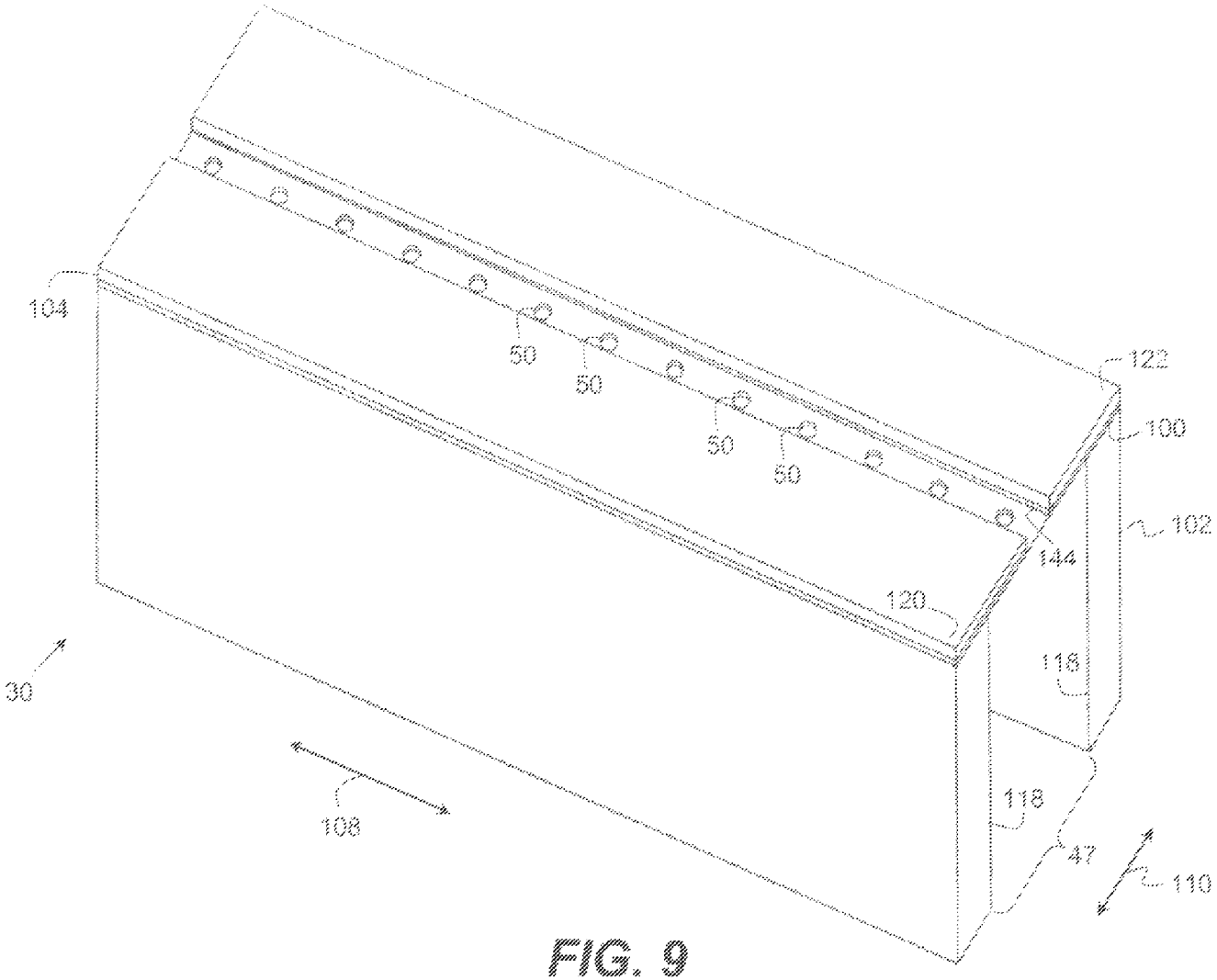
FIG. 9 is a schematic perspective view of another example embodiment of a printhead made in accordance with the present invention.
Figure 10:
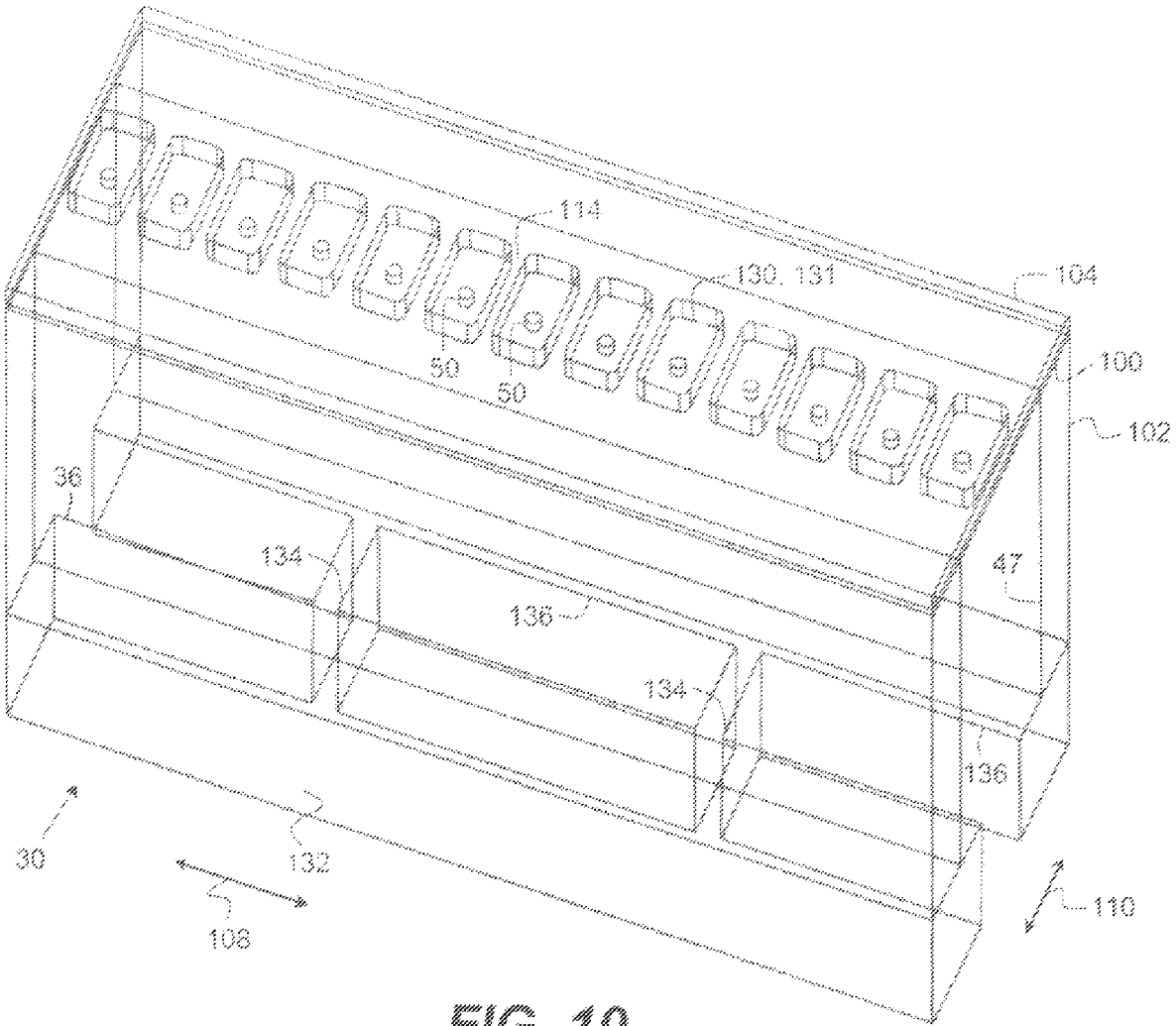
FIG. 10 is a schematic perspective view of another example embodiment of a printhead made in accordance with the present invention.

Referring to FIGS. 7, 8, and 10 and back to FIG. 5, portions 114 of support structure 104 are positioned between consecutive nozzles 50 of the plurality of nozzles 50 as viewed along the length 108 of printhead 30. This helps to reinforce nozzle membrane 100 by positioning some of support structure 104 over nozzle some of membrane 100 and some of liquid channel 47. However, referring to FIG. 9, in some embodiments of the present invention, portions of the support structure 104 are not present between consecutive nozzles 50. Instead, the nozzle membrane 100 remains free of the material that forms support structure 104. As shown, an open rectangular slot or channel 144 is formed in the vicinity of the plurality of nozzles 50 as viewed along the length dimension 108. Nozzle membrane is still reinforced because support structure 104 extends over a portion of nozzle membrane 100 and at least some of liquid feed channel 47. Additionally or alternatively, one portion 120, for example, and end, or a plurality of portions 120, 122, for example, both ends, of the support structure 104 overlap the walls 118 of the liquid feed channel 47 as viewed along the width dimension 110 of printhead 30 (as shown in FIGS. 4-10 and 12). This is done to further reinforce nozzle membrane 100.

Referring to FIGS. 7, 8, and 10, the portions 130 of the support structure 104 that are recessed relative to the inner wall 128 of recessed opening 50B of the nozzle 50 can have different shapes. For example, the recessed portion 130, 131 can be circular (FIG. 7) or rectangular (FIGS. 8 and 10). Alternatively, the shape of the recessed portion 130, 131 of support structure 104 can be elliptical or polygonal. The optimum shape of recessed portion 130, 131 depends on the ability of the support layer 104 to provide required mechanical strength as well as to minimize any undesired fluid buildup around nozzle bore 50 that can adversely affect the jet directionality.

Referring to FIG. 10, a second substrate 132 is affixed to substrate 102 (a first substrate). Second substrate 132 includes a rib or ribs 134 that span the width 110 of liquid feed channel 47. Second substrate 132 can be bonded to first substrate 102 of the CMOS-MEMS nozzle plate that also includes nozzle membrane 100 and now support structure 104. Second substrate 132 can be made of silicon and channels 136 can be etched intermediately to create ribs 134 for subsets of the plurality of nozzles. The ribs 134 of second substrate 132 help to provide additional structural robustness to the nozzle plate.

Referring to FIGS. 11A-11F, a fabrication process for making a printhead 30 in accordance with the present invention is shown. Generally, described, in order to improve the structural robustness of nozzle membrane 100 an additional film(s)(also referred to as a layer(s)), either organic, inorganic, or a combination of both, is deposited or laminated or bonded to the nozzle membrane 100 after CMOS processing of the nozzle membrane 100 is complete (also referred to a post-CMOS processing). A recess can be provided in the film(s) that create support structure 104 to create frontside "ribs" that help to reinforce nozzle membrane 100 so that nozzle membrane 100 can withstand various loads during manufacturing and operation.

As the film(s) that create support structure 104 is affixed to the nozzle plate post-CMOS, the film(s) can be selected from a more diverse variety of materials and can have a much higher thickness (when compared to nozzle membrane 100) which help improve mechanical robustness. Also, one or more coatings that create hydrophobic or hydrophilic surface properties on the nozzle plate can be applied when forming support structure 104 in order to maintain or even improve jet straightness and drop stimulation.

Figure 11A:
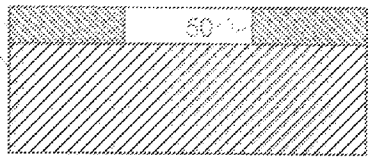
FIGS. 11A-11F are schematic cross sectional views showing an example embodiment of a fabrication process used to manufacture the printhead of the present invention.
Figure 11B:
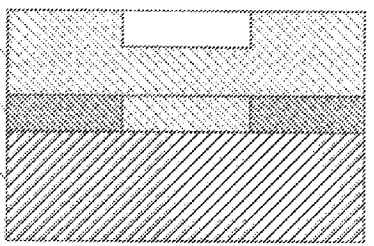

The fabrication process begins with a CMOS wafer 100 that includes polysilicon heaters and supporting electronics circuitry. Nozzle bores 50 have been etched in the dielectric membrane. CMOS layers making nozzle membrane have been attached to a substrate 102, for example, a silicon substrate (as shown in FIG. 11A). The CMOS nozzle membrane 100 is then coated with a supporting layer(s) 104 (as shown in FIG. 11B). Supporting layer 104 can be spin-coated, chemical vapor deposited (CVD), physical vapor deposited (PVD), electroplated, laminated, or bonded with or without an adhesive layer. Supporting layer 104 can be an organic material, for example, polyimide P12611, polyimide HD8000, SU8, TMMR, TMMF, or combination thereof. Supporting layer 104 can be an inorganic material, for example, aluminum, nickel, copper, silicon, silicon nitride, silicon dioxide, or combinations thereof. Supproting layer(s) 104 can also be combinations of organic and inorganic materials. As such, support structure 104 includes at least one material layer (a first material) that is different from at least one material layer (a second material) of the nozzle membrane 100. The first material is less brittle when compared to the second material and can physically contact the second material.

Figure 11C:
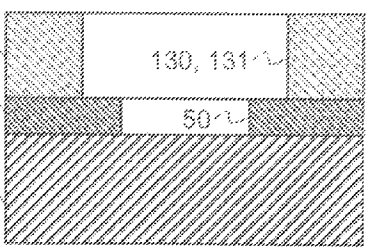
Figure 11D:
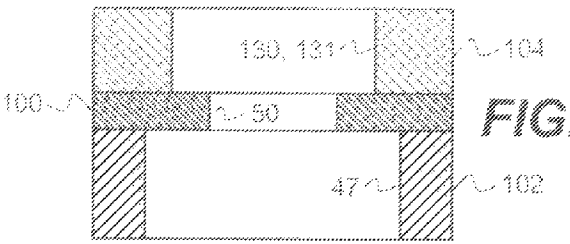

The support layer 104 is then patterned and etched to create the recesses 130, 131 around the nozzles 50 and open bond pads. Depending on the specific material(s) selected for supporting layer 104, some of the support layer materials are photoimageable while others require a photoresist or a hard mask for patterning (as shown in FIG. 11C). The recess mask is aligned to bore mask during this step. When electroplating is used, the support layer(s) is plated to have a shape that provides the recess around the nozzles and bond pad openings. Alternatively, the recesses and bond pad openings can also be etched in the support layer before attaching it to the wafer and then attached to the wafer using an aligned lamination or bonding process. This is particularly useful when the support layer is made of silicon. Grinding or chemical-mechanical polishing processes can be used to adjust the height of the support layer(s). It can be necessary to deposit etch stop and adhesion layers prior to coating some support layer materials, for example, those materials that are metals. The common liquid feed channel 47 is etched from the backside using a DRIE or anisotropic KOH wet etch along the crystal planes (as shown in FIG. 11D).

Figure 11E:
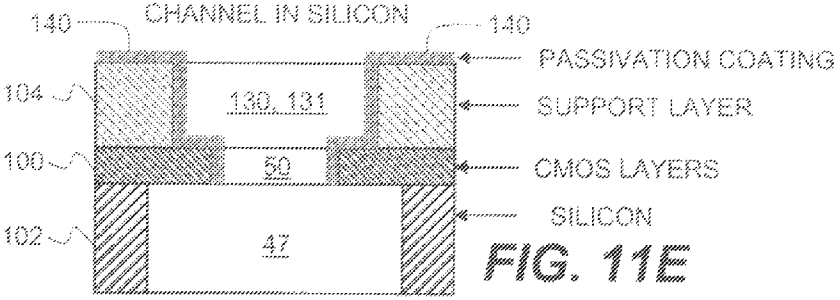
Figure 11F:
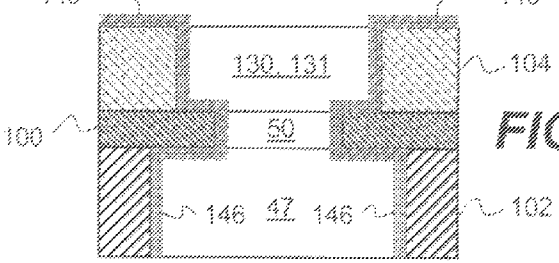

A passivation film 140 is coated and patterned, if necessary, from the frontside over an outer surface of support structure 104 and along the surfaces of recessed portions 130, 131. Film 140 can also be coated and patterned to cover the external surface of nozzle membrane 100 and the inner surface of nozzle 50 (as shown in FIG. 11E). Optionally, an additional passivation film can be coated and patterned, if necessary, from the backside over the walls of liquid feed channel 47 and the internal surface of nozzle membrane 100 (as shown in FIG. 11F). Passivation film materials can include, for example, silicon carbide, oxide, nitride, oxynitride, or parylene C. Typically, passivation film material selection depends on the type of protection required; manufacturing process compatibility; or the type of surface properties desired, for example, hydrophobic or hydrophilic. The passivation film can be coated via CVD, PVD, ALD (atomic layer deposition) and then patterned if necessary, for example, in order to expose bond pads.

The invention has been described in detail with particular reference to certain preferred embodiments thereof, but it will be understood that variations and modifications can be effected within the scope of the invention.

Parts List

20 continuous printing system
22 image source
24 image processing unit
26 mechanism control circuits
28 device
30 printhead
32 recording medium
34 recording medium transport system
36 recording medium transport control system
38 micro-controller
40 ink reservoir
42 ink catcher
44 ink recycling unit
46 ink pressure regulator
47 ink channel
48 jetting module
49 nozzle plate
50 plurality of nozzles
50A nozzle bore
50B recessed opening
51 heater
52 liquid
54 drops
56 drops
57 trajectory
58 drop stream
60 gas flow deflection mechanism
61 positive pressure gas flow structure
62 gas flow
63 negative pressure gas flow structure
64 deflection zone
66 small drop trajectory
68 large drop trajectory
72 first gas flow duct
74 lower wall
76 upper wall
78 second gas flow duct
82 upper wall
86 liquid return duct
88 plate
90 front face
92 positive pressure source
94 negative pressure source
96 wall
100 nozzle membrane
102 substrate
104 support structure
106 external surface
108 length dimension
110 width dimension
114 portions
116 portions
118 form walls
120 one portion
122 plurality of portions
124 internal surface
126 portions
128 inner wall
130 portion
131 portion
132 second substrate
134 ribs
136 channels
138 openings
140 passivation film
142 inner wall
144 slot, channel
146 passivation film

The invention claimed is:

1. A printhead comprising:

a nozzle membrane including an external surface, a length, and a plurality of nozzles located along the length of the nozzle membrane, each nozzle of the plurality of nozzles including an inner wall;

a substrate to which the nozzle membrane is affixed, the substrate including a liquid feed channel that provides liquid to the plurality of nozzles of the nozzle membrane, the liquid feed channel extending along the length of the nozzle membrane such that the liquid feed channel is common to each nozzle of the plurality of nozzles of the nozzle membrane; and a support structure affixed to the external surface of the nozzle membrane to provide structural support to the nozzle membrane, wherein portions of the support structure are recessed relative to the inner wall of the nozzle.

2. The printhead of claim 1, wherein portions of the support structure are positioned between consecutive nozzles of the plurality of nozzles.

3. The printhead of claim 2, portions of the substrate forming walls that define the liquid feed channel, wherein the support structure overlaps the walls of the liquid feed channel.

4. The printhead of claim 1, wherein the nozzle membrane further comprises a stimulation device associated with each nozzle of the plurality of nozzles.

5. The printhead of claim 4, wherein the nozzle membrane further comprises drive circuitry in electrical communication with the stimulation device.

6. The printhead of claim 1, wherein the support structure is void of any stimulation device and drive circuitry.

7. The printhead of claim 1, the support structure including at least one material layer made from a first material, the nozzle membrane including at least one material layer made from a second material, the second material being different from the first material.

8. The printhead of claim 7, wherein the first material is less brittle when compared to the second material.

9. The printhead of claim 7, wherein the at least one material layer made from the first material physically contacts the at least one material layer made from the second material.

10. The printhead of claim 1, the substrate being a first substrate, the liquid feed channel including a width, further comprising:

a second substrate affixed to the first substrate, the second substrate including a rib that spans the width of the liquid feed channel.

11. The printhead of claim 1, the nozzle membrane including an internal surface that is adjacent to the liquid feed channel, the inner surface being substantially planer.

12. The printhead of claim 1, wherein the support structure includes a hydrophobic material.

13. The printhead of claim 1, further comprising:

a source of liquid in fluid communication with the plurality of nozzles through the liquid feed channel that provides a liquid under pressure sufficient to eject jets of the liquid through the plurality of nozzles.

14. A method of printing comprising:

providing a printhead including:

a nozzle membrane including an external surface, a length, and a plurality of nozzles located along the length of the nozzle membrane, each nozzle of the plurality of nozzles including an inner wall;

a substrate to which the nozzle membrane is affixed, the substrate including a liquid feed channel that provides liquid to the plurality of nozzles of the nozzle membrane, the liquid feed channel extending along the length of the nozzle membrane such that the liquid feed channel is common to each nozzle of the plurality of nozzles of the nozzle membrane;

a support structure affixed to the external surface of the nozzle membrane to provide structural support to the nozzle membrane, portions of the support structure being recessed relative to the inner wall of the nozzle; and a drop stimulation device;

providing a liquid under pressure sufficient to eject jets of the liquid through the plurality of nozzles; and actuating the drop stimulation device to form drops from the jets of liquid.

15. A printhead comprising:

a nozzle membrane including an external surface, a length, and a plurality of nozzles located along the length of the nozzle membrane;

a first substrate to which the nozzle membrane is affixed, the substrate including a liquid feed channel that provides liquid to the plurality of nozzles of the nozzle membrane, the liquid feed channel extending along the length of the nozzle membrane such that the liquid feed channel is common to each nozzle of the plurality of nozzles of the nozzle membrane, the liquid feed channel including a width;

a second substrate affixed to the first substrate, the second substrate including a rib that spans the width of the liquid feed channel; and a support structure affixed to the external surface of the nozzle membrane to provide structural support to the nozzle membrane.

16. The printhead of claim 15, portions of the substrate forming walls that define the liquid feed channel, wherein the support structure overlaps the walls of the liquid feed channel.

17. The printhead of claim 15, wherein portions of the support structure are positioned between consecutive nozzles of the plurality of nozzles.

18. The printhead of claim 15, wherein the nozzle membrane further comprises a stimulation device associated with each nozzle of the plurality of nozzles.

19. The printhead of claim 18, wherein the nozzle membrane further comprises drive circuitry in electrical communication with the stimulation device.

20. The printhead of claim 15, the support structure including at least one material layer made from a first material, the nozzle membrane including at least one material layer made from a second material, the second material being different from the first material.

* * * * *